US005090591A

United States Patent [19]

Long

[11] Patent Number: 5,090,591

[45] Date of Patent: Feb. 25, 1992

[54] ARTICLE DISPENSER FOR USE WITH CONTINUOUS STRIP OF ARTICLES

[75] Inventor: John D. Long, Scarborough, Canada

[73] Assignee: Longford Equipment International Limited, Scarborough, Canada

[21] Appl. No.: 671,106

[22] Filed: Mar. 18, 1991

[51] Int. Cl.[5] ..... G07F 11/66

[52] U.S. Cl. ..... 221/25; 221/30; 83/945

[58] Field of Search ..... 221/30, 31, 32, 25, 221/64, 95; 83/945, 946, 418; 53/389, 202

[56] References Cited

U.S. PATENT DOCUMENTS 3,179,288 4/1965 Davy ..... 221/30
3,964,638 6/1976 Dimauro ..... 221/30
4,253,364 3/1981 Kiefer et al. ..... 83/945

*Primary Examiner*—Robert P. Olszewski
*Assistant Examiner*—Kenneth Noland
*Attorney, Agent, or Firm*—Smart & Biggar

[57] ABSTRACT

A dispenser for a continuous strip of articles has two grippers with cantilevered gripping arms, one gripper positioned at each side of the strip. One of the grippers grips the end article in the continuous strip of articles and moves the end article downstream to a dispensing station through the open arms of the other gripper which moves upstream to a gripping position whereas it grips the article adjacent the end article. A cutter severs the article at the dispensing station from the continuous strip and the downstream gripper opens to dispense the article. The upstream gripper now grips the end article and may move downstream through the open gripping arms of the other gripper for dispensing this next article and this process may be repeated.

6 Claims, 5 Drawing Sheets

ARTICLE DISPENSER FOR USE WITH CONTINUOUS STRIP OF ARTICLES

BACKGROUND OF THE INVENTION

1. Field of the Invention

This invention relates to a method and apparatus for conveying and/or dispensing articles from a continuous strip of articles.

2. Description of the Related Art

Where it is desired to dispense an article, typically a wrapped toy, in packages containing comestibles, typically a cereal box containing cereal, a known wrapping machine is generally employed to wrap the toys in a continuous strip of film which is heat sealed between adjacent toys. The film is then typically severed at each heat seal and the articles manually dropped into each package.

This known approach to dispensing articles from a continuous strip of articles is time consuming and labour intensive. The subject invention seeks to overcome drawbacks of known prior art.

SUMMARY OF THE INVENTION

According to the present invention, there is provided a dispenser for dispensing articles from the end of a continuous strip of articles feedable along its length in a downstream direction, comprising: a first gripper having cantilevered gripping arms which may be opened or closed and a second gripper having cantilevered gripping arms which may be opened or closed, said first gripper for gripping a continuous strip of articles from one side of the strip and said second gripper for gripping the continuous strip of articles from the opposite side of the strip; first motive means for reciprocating said first gripper along a portion of one side of said continuous strip of articles and second motive means for reciprocating said second gripper along a portion of the opposite side of said continuous strip of articles; cutting means for severing articles from said strip of articles; control means operatively associated with said first and second grippers, said first and second motive means and said cutting means for, repetitively, (i) moving said first gripper to a gripping position upstream of said second gripper when said second gripper is in an open position and for closing said cantilevered arms of said first gripper in order to grip the continuous strip of articles, (ii) moving said first gripper downstream through the open cantilevered arms of said second gripper in order to move an article of said continuous strip of articles to a dispensing position, (iii) activating said cutting means and opening said first gripper in order to dispense an article, (iv) moving said second gripper to a gripping position upstream of said first gripper and closing said cantilevered arms of said second gripper in order to grip the continuous strip of articles, (v) moving said second gripper through the open arms of said first gripper in order to move an article of said continuous strip of articles to a dispensing position and activating said cutting means, and (vi) opening said second gripper in order to dispense an article.

In another aspect, there is provided a method of dispensing articles from the end of a continuous strip of articles feedable along its length in a downstream direction, comprising the steps of: gripping a continuous strip of articles upstream of a first gripper at one side of the strip having cantilevered arms with a second gripper at the other side of the strip having cantilevered arms; opening the arms of said first gripper and moving said first gripper in an upstream direction to a gripping position; moving said second gripper in a downstream direction through the open arms of said first gripper so that the end article in said continuous strip of articles is moved to a dispensing position; severing said end article from said strip and dispensing said end article; gripping said strip with said first gripper; opening the arms of said second gripper and moving said second gripper upstream to a gripping position; moving said first gripper in a downstream direction through the open arms of said second gripper so that the end article in said continuous strip of articles is moved to a dispensing position; severing said end article from said strip and dispensing said end article; and repeating the foregoing steps, as required.

In yet another aspect, there is provided a conveyor for conveying a continuous strip of articles along its length in a downstream direction, comprising: a first gripper having cantilevered gripping arms which may be opened or closed and a second gripper having cantilevered gripping arms which may be opened or closed, said first gripper for gripping a continuous strip of articles from one side of the strip and said second gripper for gripping the continuous strip of articles from the opposite side of the strip; first motive means for reciprocating said first gripper along a portion of one side of said continuous strip of articles and second motive means for reciprocating said second gripper along a portion of the opposite side of said continuous strip of articles; control means operatively associated with said first and second grippers and said first and second motive means for, repetitively, (i) moving said first gripper to a gripping position upstream of said second gripper when said second gripper is in an open position and for closing said cantilevered arms of said first gripper in order to grip the continuous strip of articles, (ii) moving said first gripper downstream through the open cantilevered arms of said second gripper in order to move said continuous strip of articles in said downstream direction, (iii) opening said first gripper, (iv) moving said second gripper to a gripping position upstream of said first gripper and closing said cantilevered arms of said second gripper in order to grip the continuous strip of articles, (v) moving said second gripper through the open arms of said first gripper in order to move said continuous strip of articles in said downstream direction, and (vi) opening said second gripper.

BRIEF DESCRIPTION OF THE DRAWINGS

In the figures which disclose example embodiments of the invention.

DESCRIPTION OF THE PREFERRED EMBODIMENTS

Figure 1:
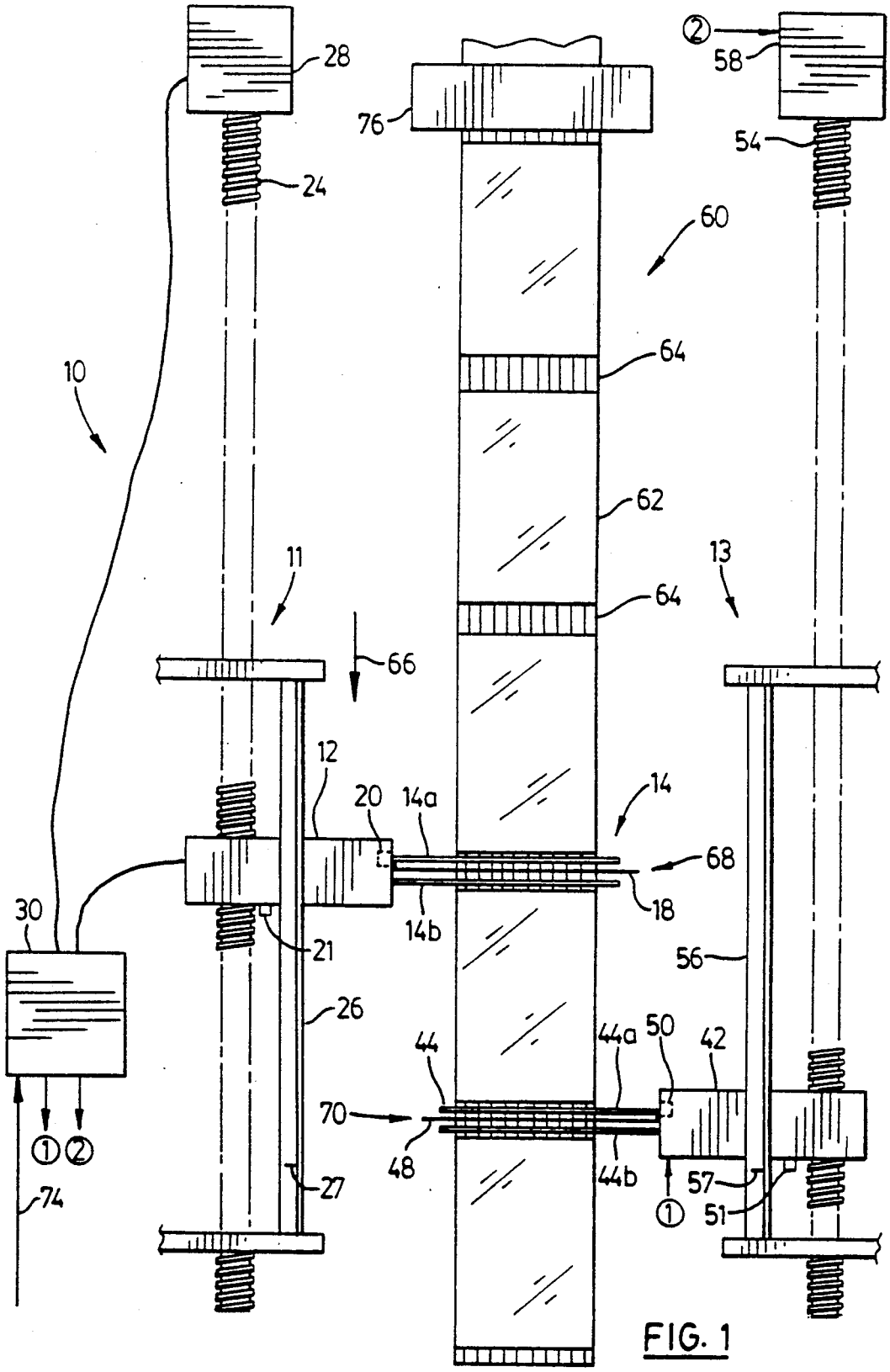
FIG. 1 is a schematic front view of a dispenser made in accordance with this invention shown with a continuous strip of articles.
Figure 2:
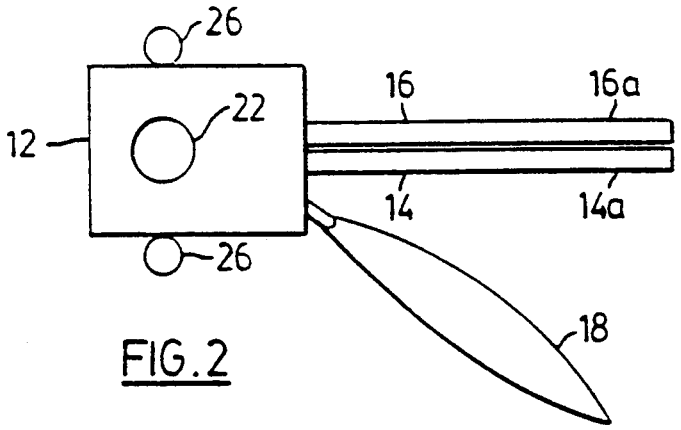
FIGS. 2 and 3 are schematic top views of a portion of the dispenser of FIG. 1, and FIGS. 4 through 6 are simplified front schematic views illustrating the operation of the dispenser of this invention.

Turning to FIGS. 1 and 2, a dispensing means 10 comprises two identical opposed sub-assemblies 11 and 13. The first subassembly 11 comprises a first gripper 12 having cantilevered arms 14 and 16. Each of the two cantilevered arms 14 and 16 comprise two parallel spaced fingers 14*a*, 14*b* and 16*a*, 16*b* (not shown), respectively. Furthermore, the first gripper supports a doublesided fly through knife 18 and optical sensors 20 and 21. The first gripper has a threaded opening 22 for reception of lead screw 24. Guides 26 restrain the gripper to up or down motion when shaft 24 is rotated. The guides 26 also have a position marker 27. A bi-directional motor 28 rotates lead screw 24 so that the gripper may be reciprocated in order to move the gripper between a gripping position (illustrated at 68) and a dispensing position (illustrated at 70).

The second sub-assembly 13 comprises a second gripper 42 with cantilevered arm 44 and 46 (not shown) having fingers 44*a*, 44*b* and 46*a*, 46*b* (not shown). The gripper supports a doublesided fly through knife 48 and optical sensors 50 and 51. The second gripper is threadably supported by lead screw 54 and guides 56 restrain the gripper to up or down motion when lead screw 54 is rotated. The guides have a position marker 57. A bi-directional motor 58 rotates shaft 54.

A controller 30 is operatively connected to the control input for the motors 28, 58, the cantilevered gripping arms 14, 16 and 44, 46 of the two grippers, and the fly through knives 18, 48. In addition, the controller receives signals from the sensors 20, 21, 50, and 51. The controller also receives dispense requests on line 74. The sensor 21 sends a signal when it detects position marker 27 and the sensor 51 sends a signal when it detects position marker 57. The sensors 20 and 50 send a detection signal each time they detect a zone 64 of a continuous strip 60 fed between the two sub-assemblies 11 and 13. The continuous strip 60 comprises articles 62 which terminate at the noted zones 64. Zones 64 may be heat seals. The continuous strip is fed between the two sub-assemblies 11 and 13 such that when the first gripper 12 is in its "closed" gripping position (illustrated in FIG. 2) it grips the continuous strip of articles from one side thereof and when the second gripper 42 is in its "closed" gripping position, it grips the continuous strip of articles from the opposite side of the strip. The grippers grip the continuous strip of articles at zones 64. A tensioning device 76 imparts a drag force to the continuous strip of articles when the strip is moved.

Figure 3:
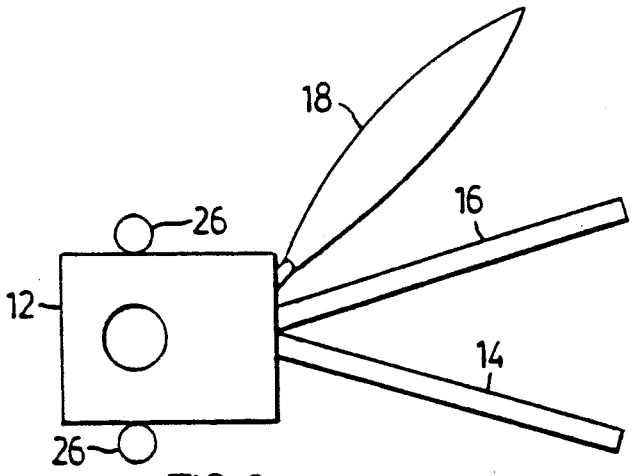

FIG. 3 illustrates the first gripper 12 in an "open" position with the cantilevered arms 14 and 16 separated at their free end. In addition, FIG. 3 illustrates the fly through knife 18 at one of its two extreme positions and FIG. 2 illustrates the knife in the other of its two extreme positions.

The downstream feeding direction of the continuous strip of articles, which is parallel to the lengthwise dimension of the strip, is illustrated at 66.

Figure 4:
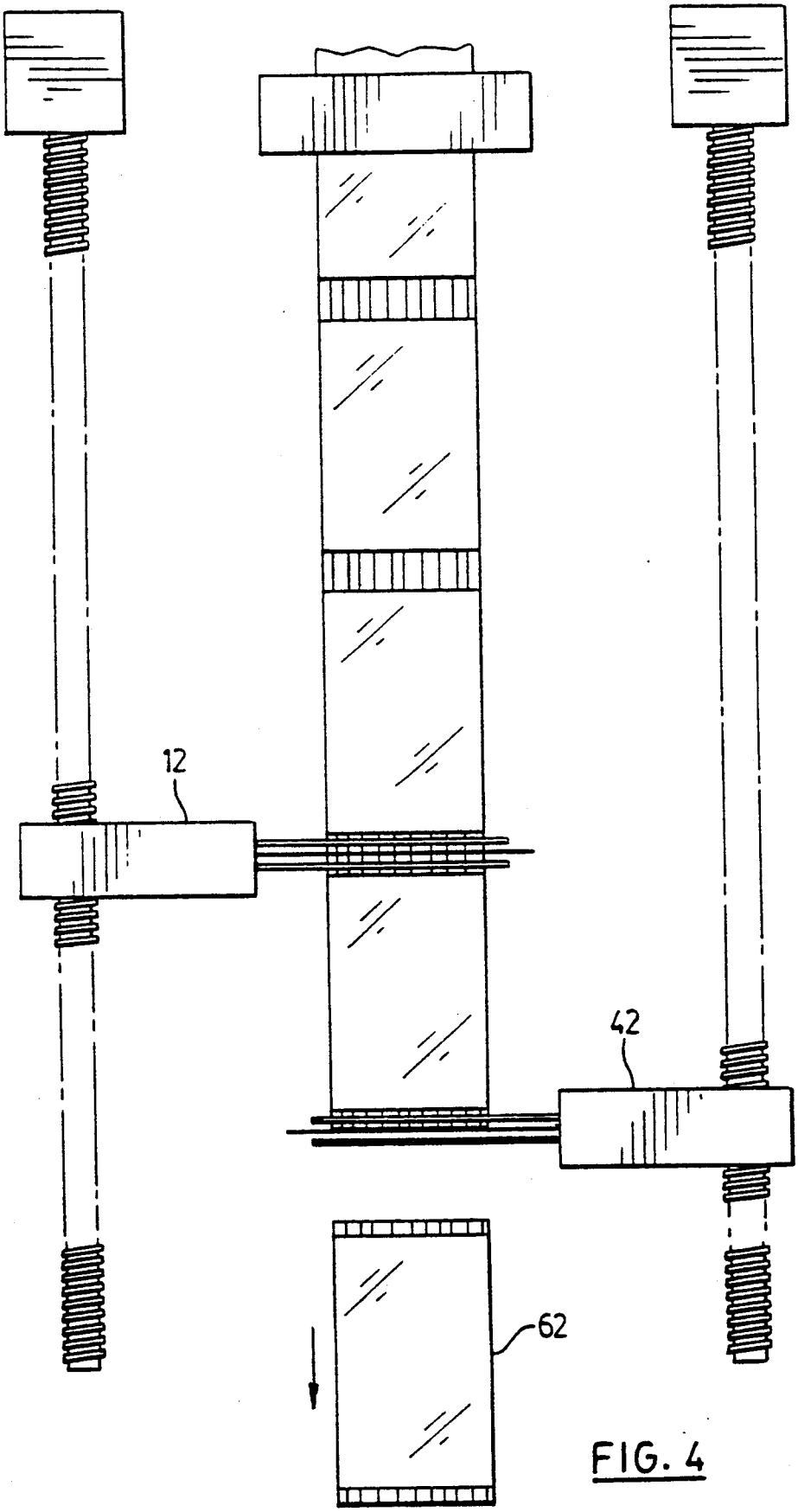

Assuming the dispenser is initially in the position of FIG. 1 with the first gripper gripping the strip 60 at a zone 64 upstream of the second gripper 42 and with the second gripper gripping the continuous strip at the zone 64 between the last article of the strip and the next adjacent article, the operation of the dispenser is as follows. When the controller receives a "dispense request" signal on line 74, a control signal may be sent from the controller 30 to the control input for the fly through knife 48 causing the knife to move from one of its two extreme positions to the other of its two extreme positions and thereby cut the continuous strip of articles at the gripped zone 64 so that the last article of the strip is severed from the strip. The article will still be held by the lower fingers 44*b*, 46*b* of the second gripper 42. The controller then sends a control signal to the control input for the cantilevered arms of the second gripper 42 causing them to move to their open position which releases the severed last article so that it is dispensed under the force of gravity. This dispensing operation is illustrated in FIG. 4.

Figure 5:
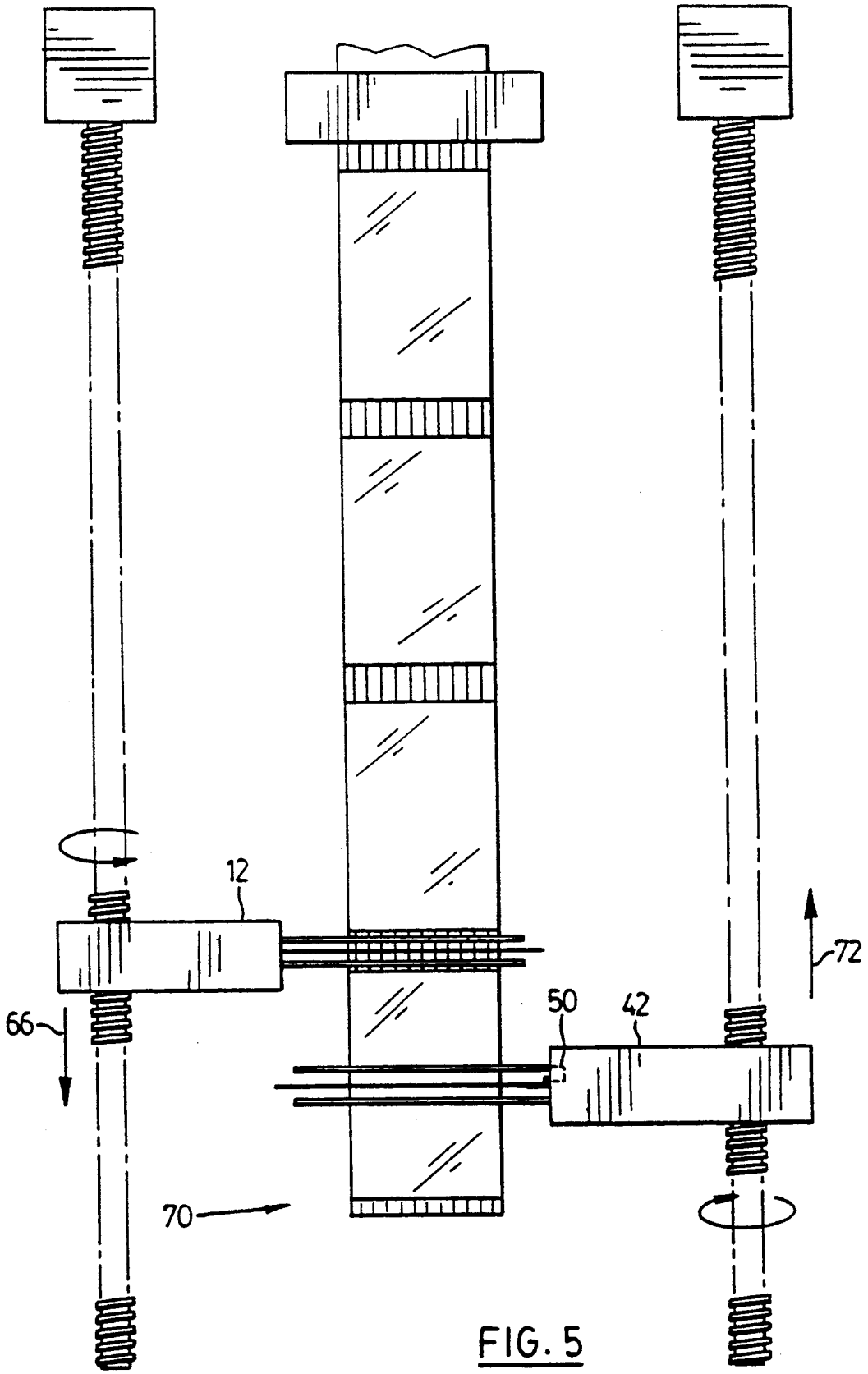

With reference to FIG. 5, after dispensing an article, the controller prepares for the dispensing of a further article, as follows. The controller sends an appropriate control signal to the motor 58 so that the second gripper 42 moves upstream (illustrated at 72) toward a gripping position and furthermore sends an appropriate control signal to the motor 28 so that the first gripper 12 moves downstream (illustrated at 66) toward the dispensing position 70. Since the cantilevered arms of the second gripper 42 are in an open position and the cantilevered arms of the first gripper 12 are in a closed position, downstream motion of the first gripper 12 pulls the continuous strip of articles in the downstream direction 66 (against the drag of the tensioning device 76 which keeps the continuous strip of articles taut) and, furthermore, this results in the arms of the grippers passing through each other without interference as the grippers move past each other. When the sensor 21 of gripper 12 detects the position marker 27 this indicates gripper 12 has reached the dispensing position; the controller responds by stopping motor 28.

Figure 6:
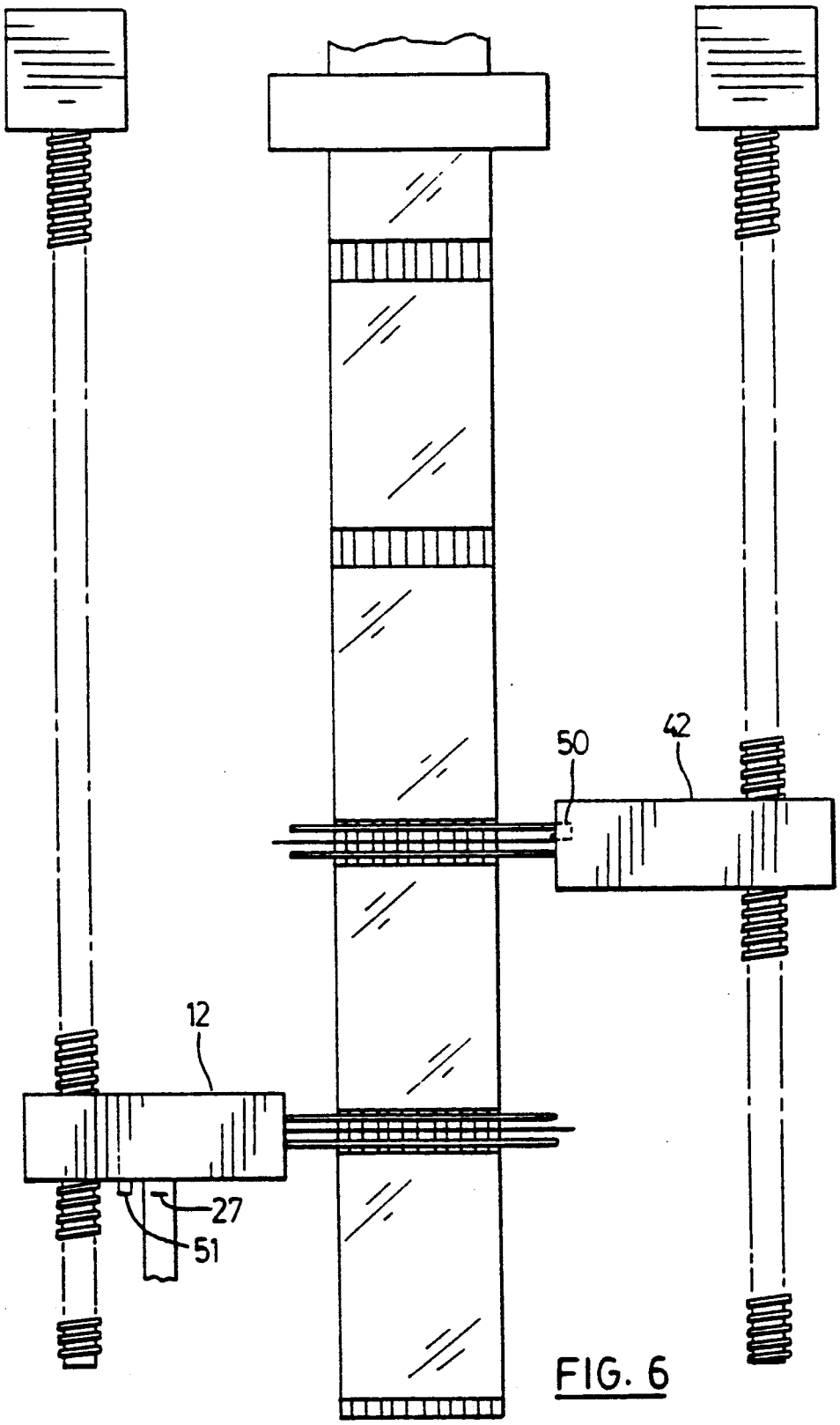

The gripping position for gripper 42 is found as follows. Sensor 50 sends a detection signal to the controller each time it encounters a zone 64. The controller ignores the first such detection, which is indicative of the zone to which the first gripper is gripped, and responds to the second such indication, which indicates the first zone upstream of the first gripper, to send a gripper arm closing signal to the second gripper so that the gripper grips this zone 64 upstream of the first gripper. This result is illustrated in FIG. 6. For reasons which will become apparent hereinafter, it is generally preferable that the second gripper reaches the gripping position and grips the strip of articles thereat prior to the first gripper reaching the dispensing position. To achieve this end, the controller 30 sends appropriate control signals to the motors 28 and 58 so that the second gripper moves more quickly than the first gripper. Upon the second gripper reaching the gripping station, the controller not only closes the gripping arms of the gripper but also changes the control signal to motor 58 so that the second gripper reverses direction and tracks the first gripper in a downstream direction. The controller then stops both motors upon receipt of a signal from sensor 21 that the first gripper has reached the dispensing position.

It will be recognised that FIG. 6 is identical to FIG. 1 except that grippers 12 and 42 have reversed position. Thus, the operation may now repeat with the fly through knife of gripper 12 severing the last article from the strip, gripper 12 opening to dispense the article and gripper 12 moving upstream and gripper 42 downstream to return to the position of FIG. 1.

The dispenser of this invention may be utilised to drop articles into open packages. In this regard, a conveyer may be positioned beneath the dispenser for conveying open packages under the dispenser. A microswitch or photocell associated with the conveyer may be employed to sense the presence of an open package beneath the dispenser and this indication is sent to the controller 30 on the dispense request line 74 prompting the controller to cause the dispensing of an article 62.

It will be apparent that the dispenser of this invention may dispense articles which are bulky products, such as plastic toys, sheathed in film. Furthermore, the dispenser could be employed with a roll of coupons or the like having some registration marking between adjacent coupons (which could be sensed by sensors 20 and 50).

The dispenser may operate intermittently to dispense articles as required. Where continuous operation is needed, dispensing speed is increased if the cutting operation is performed as a gripper moves downstream to the dispensing position and if the gripper moving upstream to a gripping position moves more quickly than the gripper moving downstream, as described hereinbefore.

The fly through knife associated with each gripper could be replaced by a single stand alone cutting station positioned at the dispensing position. Alternatively, the fly through knife of a gripper could be replaced by a knife component mounted to each arm of the gripper such that the knife components close with the arms of the grippers to sever the continuous strip of articles between the fingers of the arms as the fingers grip the continuous strip of articles. The continuous strip of articles may be pulled downstream solely by the grippers 12 and 42; where, however, the continuous strip has a large inertia, a motorised downstream feed may be employed for the strip upstream of the tensioning device 76. Where the dispenser is only used to intermittently dispense articles such that the grippers may move at the same speed, motors 28 and 58 may be replaced by a single motor and appropriate gearing to each lead screw. Optical sensors 20 and 50 could be replaced with thickness detectors or some other suitable zone detection means.

By omitting the fly through knives associated with the grippers, this invention has utility as a conveyor for a continuous strip of articles.

Other modifications will be apparent to those skilled in the art and, accordingly, the invention is defined in the claims.

What is claimed is:

1. A dispenser for dispensing articles from the end of a continuous strip of articles feedable along its length in a downstream direction, comprising:

a first gripper having cantilevered gripping arms which may be opened or closed and a second gripper having cantilevered gripping arms which may be opened or closed, said first gripper for gripping a continuous strip of articles from one side of the strip and said second gripper for gripping the continuous strip of articles from the opposite side of the strip;

first motive means for reciprocating said first gripper along a portion of one side of said continuous strip of articles and second motive means for reciprocating said second gripper along a portion of the opposite side of said continuous strip of articles;

cutting means for severing articles from said strip of articles;

control means operatively associated with said first and second grippers, said first and second motive means and said cutting means for, repetitively, (i) moving said first gripper to a gripping position upstream of said second gripper when said second gripper is in an open position and for closing said cantilevered arms of said first gripper in order to grip the continuous strip of articles, (ii) moving said first gripper downstream through the open cantilevered arms of said second gripper in order to move an article of said continuous strip of articles to a dispensing position, (iii) activating said cutting means and opening said first gripper in order to dispense an article, (iv) moving said second gripper to a gripping position upstream of said first gripper and closing said cantilevered arms of said second gripper in order to grip the continuous strip of articles, (v) moving said second gripper through the open arms of said first gripper in order to move an article of said continuous strip of articles to a dispensing position and activating said cutting means, and (vi) opening said second gripper in order to dispense an article.

2. The dispenser of claim 1 further including sensing means for sensing the position of articles of said continuous strip of articles and wherein said control means is responsive to said sensing means.

3. The dispenser of claim 2 wherein said cutting means comprises a cutter associated with each of said first and second gripper.

4. The dispenser of claim 3 wherein each arm of each of said first gripper and second gripper comprises a pair of neighbouring fingers and wherein said cutter associated with each of said first gripper and said second gripper is for cutting the continuous strip of articles between said pairs of neighbouring fingers.

5. A method of dispensing articles from the end of a continuous strip of articles feedable along its length in a downstream direction, comprising the steps of:

gripping a continuous strip of articles upstream of a first gripper at one side of the strip having cantilevered arms with a second gripper at the other side of the strip having cantilevered arms;

opening the arms of said first gripper and moving said first gripper in an upstream direction to a gripping position;

moving said second gripper in a downstream direction through the open arms of said first gripper so .hat the end article in said continuous strip of articles is moved to a dispensing position;

severing said end article from said strip and dispensing said end article;

gripping said strip with said first gripper;

opening the arms of said second gripper and moving said second gripper upstream to a gripping position;

moving said first gripper in a downstream direction through the open arms of said second gripper so that the end article in said continuous strip of articles is moved to a dispensing position;

severing said end article from said strip and dispensing said end article; and repeating the foregoing steps, as required.

6. A conveyor for conveying a continuous strip of articles along its length in a downstream direction, comprising:

a first gripper having cantilevered gripping arms which may be opened or closed and a second gripper having cantilevered gripping arms which may be opened or closed, said first gripper for gripping a continuous strip of articles from one side of the strip and said second gripper for gripping the continuous strip of articles from the opposite side of the strip;

first motive means for reciprocating said first gripper along a portion of one side of said continuous strip of articles and second motive means for reciprocating said second gripper along a portion of the opposite side of said continuous strip of articles;

control means operatively associated with said first and second grippers and said first and second motive means for, repetitively, (i) moving said first gripper to a gripping position upstream of said second gripper when said second gripper is in an open position and for closing said cantilevered arms of said first gripper in order to grip the continuous strip of articles, (ii) moving said first gripper downstream through the open cantilevered arms of said second gripper in order to move said continuous strip of articles in said downstream direction, (iii) opening said first gripper, (iv) moving said second gripper to a gripping position upstream of said first gripper and closing said cantilevered arms of said second gripper in order to grip the continuous strip of articles, (v) moving said second gripper through the open arms of said first gripper in order to move said continuous strip of articles in said downstream direction, and (vi) opening said second gripper.

* * * * *